US011618265B2

(12) United States Patent
Uchida et al.

(10) Patent No.: US 11,618,265 B2
(45) Date of Patent: Apr. 4, 2023

(54) LIQUID EJECTING HEAD AND LIQUID EJECTING APPARATUS

(71) Applicant: SEIKO EPSON CORPORATION, Tokyo (JP)

(72) Inventors: Kazuaki Uchida, Fujimi-Machi (JP); Yuma Fukuzawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 70 days.

(21) Appl. No.: 17/222,685

(22) Filed: Apr. 5, 2021

(65) Prior Publication Data

US 2021/0221146 A1 Jul. 22, 2021

Related U.S. Application Data

(63) Continuation of application No. 16/721,192, filed on Dec. 19, 2019, now Pat. No. 11,007,789.

(30) Foreign Application Priority Data

Dec. 21, 2018 (JP) ..... 2018-239217
Dec. 21, 2018 (JP) ..... 2018-239219
(Continued)

(51) Int. Cl.
*B41J 2/18* (2006.01)
*B41J 2/14* (2006.01)

(52) U.S. Cl.
CPC . *B41J 2/18* (2013.01); *B41J 2/14* (2013.01); *B41J 2/14233* (2013.01);
(Continued)

(58) Field of Classification Search
CPC ... B41J 2/18; B41J 2/14; B41J 2202/12; B41J 2002/14241; B41J 2002/14362; B41J 2/14233; B41J 2202/11
See application file for complete search history.

(56) References Cited

U.S. PATENT DOCUMENTS 5,790,152 A 8/1998 Harrington
6,457,796 B1 10/2002 Fujii
(Continued)

FOREIGN PATENT DOCUMENTS

CN 108656747 10/2018
JP H02500584 3/1990
(Continued)

OTHER PUBLICATIONS

U.S. Appl. No. 16/721,192, filed Nov. 12, 2020, Office Action.
(Continued)

*Primary Examiner* — Yaovi M Ameh
(74) *Attorney, Agent, or Firm* — Workman Nydegger

(57) ABSTRACT

A liquid ejecting head including a plurality of nozzles, a row of individual flow paths that includes a plurality of individual flow paths arranged in parallel along a second axis orthogonal to the first axis when viewed in a direction of the first axis, and a common liquid chamber that is commonly in communication with the plurality of individual flow paths. In the liquid ejecting head, the plurality of individual flow paths include a first individual flow path and a second individual flow path that are adjacent to each other in the row of individual flow paths, and the level of a first opening that is a connection port between the common liquid chamber and the first individual flow path and the level of a second opening that is a connection port between the common liquid chamber and the second individual flow path are different.

14 Claims, 9 Drawing Sheets

(30) Foreign Application Priority Data

| | | |
|---|---|---|
| Dec. 21, 2018 | (JP) | 2018-239220 |
| Mar. 25, 2019 | (JP) | 2019-056087 |
| Jul. 31, 2019 | (JP) | 2019-140488 |

(52) U.S. Cl.
CPC ..... *B41J 2002/14241* (2013.01); *B41J 2002/14362* (2013.01); *B41J 2202/11* (2013.01); *B41J 2202/12* (2013.01)

(56) References Cited

U.S. PATENT DOCUMENTS

| | | | | |
|---|---|---|---|---|
| 2004/0263583 | A1 | 12/2004 | Kanada et al. | |
| 2008/0316278 | A1 | 12/2008 | Van den Bergen | |
| 2010/0238238 | A1* | 9/2010 | Yamamoto | B41J 2/18 347/85 |
| 2011/0199438 | A1* | 8/2011 | Kobayashi | B41J 2/14032 347/85 |
| 2013/0233939 | A1* | 9/2013 | Uezawa | B05B 17/0615 239/102.1 |
| 2017/0190179 | A1 | 7/2017 | Menzel et al. | |
| 2018/0264837 | A1 | 9/2018 | Matsuo et al. | |
| 2018/0281402 | A1 | 10/2018 | Giusti et al. | |
| 2019/0100004 | A1 | 4/2019 | Nakagawa | |
| 2019/0291447 | A1 | 9/2019 | Sugiura | |
| 2020/0070511 | A1 | 3/2020 | Giusti et al. | |

FOREIGN PATENT DOCUMENTS

| | | |
|---|---|---|
| JP | 2005-022137 | 1/2005 |
| JP | 2013184372 | 9/2013 |
| JP | 2015-131475 | 7/2015 |
| JP | 2015-212101 | 11/2015 |
| JP | 2016-150487 | 8/2016 |
| JP | 2017144699 | 8/2017 |
| JP | 2018-099822 | 6/2018 |
| JP | 2018-153920 | 10/2018 |
| WO | 1989002577 | 3/1989 |
| WO | 16/114396 | 7/2016 |

OTHER PUBLICATIONS

U.S. Appl. No. 16/721,192, filed Feb. 26, 2021, Notice of Allowance.
U.S. Appl. No. 16/722,766, filed Oct. 23, 2020, Restriction Requirement.
U.S. Appl. No. 16/722,766, filed Nov. 30, 2020, Office Action.
U.S. Appl. No. 16/722,766, filed Feb. 22, 2021, Final Office Action.

* cited by examiner

LIQUID EJECTING HEAD AND LIQUID EJECTING APPARATUS

The present application is a continuation of U.S. patent application Ser. No. 16/721,192, filed Dec. 19, 2019, which claims priority to JP Patent Application Nos. 2018-239217, filed Dec. 21, 2018, 2018-239219, filed Dec. 21, 2018, 2018-239220, filed Dec. 21, 2018, 2019-056087, filed Mar. 25, 2019, and 2019-140488, filed Jul. 31, 2019, the disclosures of which are hereby incorporated by reference herein in their entireties.

BACKGROUND

1. Technical Field

The present disclosure relates to a liquid ejecting head and a liquid ejecting apparatus.

2. Related Art

Hitherto, a liquid ejecting head that ejects a liquid, such as ink, from a plurality of nozzles has been proposed. For example, JP-A-2013-184372 discloses a configuration in which a liquid is ejected from nozzles by changing pressures inside pressure chambers that are in communication with the nozzles.

In liquid ejecting heads of recent years, there is a very high demand for high density nozzles. However, when a large number of nozzles are formed with high density, a phenomenon (hereinafter, referred to as "crosstalk") in which a pressure change in one of the pressure chambers affects a pressure change in an adjacent pressure chamber occurs, which becomes a problem. When crosstalk occurs, errors occur in ink ejection characteristics of each nozzle.

SUMMARY

In order to overcome the above issue, a liquid ejecting head according to an aspect of the present disclosure includes a plurality of nozzles that eject a liquid along a first axis, a row of individual flow paths that includes a plurality of individual flow paths arranged in parallel along a second axis orthogonal to the first axis when viewed in a direction of the first axis, and a common liquid chamber that is commonly in communication with the plurality of individual flow paths. In the liquid ejecting head, the plurality of individual flow paths include a first individual flow path and a second individual flow path that are adjacent to each other in the row of individual flow paths, and a position of a first opening that is a connection port between the common liquid chamber and the first individual flow path and a position of a second opening that is a connection port between the common liquid chamber and the second individual flow path are different in the direction of the first axis.

A liquid ejecting head according to another aspect of the present disclosure includes a plurality of nozzles that eject a liquid along a first axis, a row of individual flow paths that includes a plurality of individual flow paths arranged in parallel along a second axis orthogonal to the first axis when viewed in a direction of the first axis, a first common liquid chamber that is commonly in communication with the plurality of individual flow paths, and a second common liquid chamber that is commonly in communication with the plurality of individual flow paths. In the liquid ejecting head, the plurality of individual flow paths include a first individual flow path and a second individual flow path that are adjacent to each other in the row of individual flow paths, a position of a first opening that is a connection port between the first common liquid chamber and the first individual flow path and a position of a second opening that is a connection port between the first common liquid chamber and the second individual flow path are different in the direction of the first axis, and a position of a third opening that is a connection port between the second common liquid chamber and the first individual flow path and a position of a fourth opening that is a connection port between the second common liquid chamber and the second individual flow path are different in the direction of the first axis.

A liquid ejecting head according to another aspect of the present disclosure includes a plurality of nozzles that eject a liquid along a first axis, a row of individual flow paths that includes a plurality of individual flow paths arranged in parallel along a second axis orthogonal to the first axis when viewed in a direction of the first axis, and a common liquid chamber that is commonly in communication with the plurality of individual flow paths. In the liquid ejecting head, the plurality of individual flow paths include a first individual flow path and a second individual flow path that are adjacent to each other in the row of individual flow paths, and a direction of a first opening that is a connection port between the common liquid chamber and the first individual flow path and a direction of a second opening that is a connection port between the common liquid chamber and the second individual flow path are different.

A liquid ejecting head according to another aspect of the present disclosure includes a plurality of nozzles that eject a liquid along a first axis, a row of individual flow paths that includes a plurality of individual flow paths arranged in parallel along a second axis orthogonal to the first axis when viewed in a direction of the first axis, a first common liquid chamber that is commonly in communication with the plurality of individual flow paths, and a second common liquid chamber that is commonly in communication with the plurality of individual flow paths. In the liquid ejecting head, the plurality of individual flow paths include a first individual flow path and a second individual flow path that are adjacent to each other in the row of individual flow paths, a direction of a first opening that is a connection port between the first common liquid chamber and the first individual flow path and a direction of a second opening that is a connection port between the first common liquid chamber and the second individual flow path are different, and a direction of a third opening that is a connection port between the second common liquid chamber and the first individual flow path and a direction of a fourth opening that is a connection port between the second common liquid chamber and the second individual flow path are different. Note that the present disclosure is specified as a liquid ejecting apparatus that includes the liquid ejecting head according to each of the aspects described above.

DESCRIPTION OF EXEMPLARY EMBODIMENTS

Exemplary Embodiment

Figure 1:
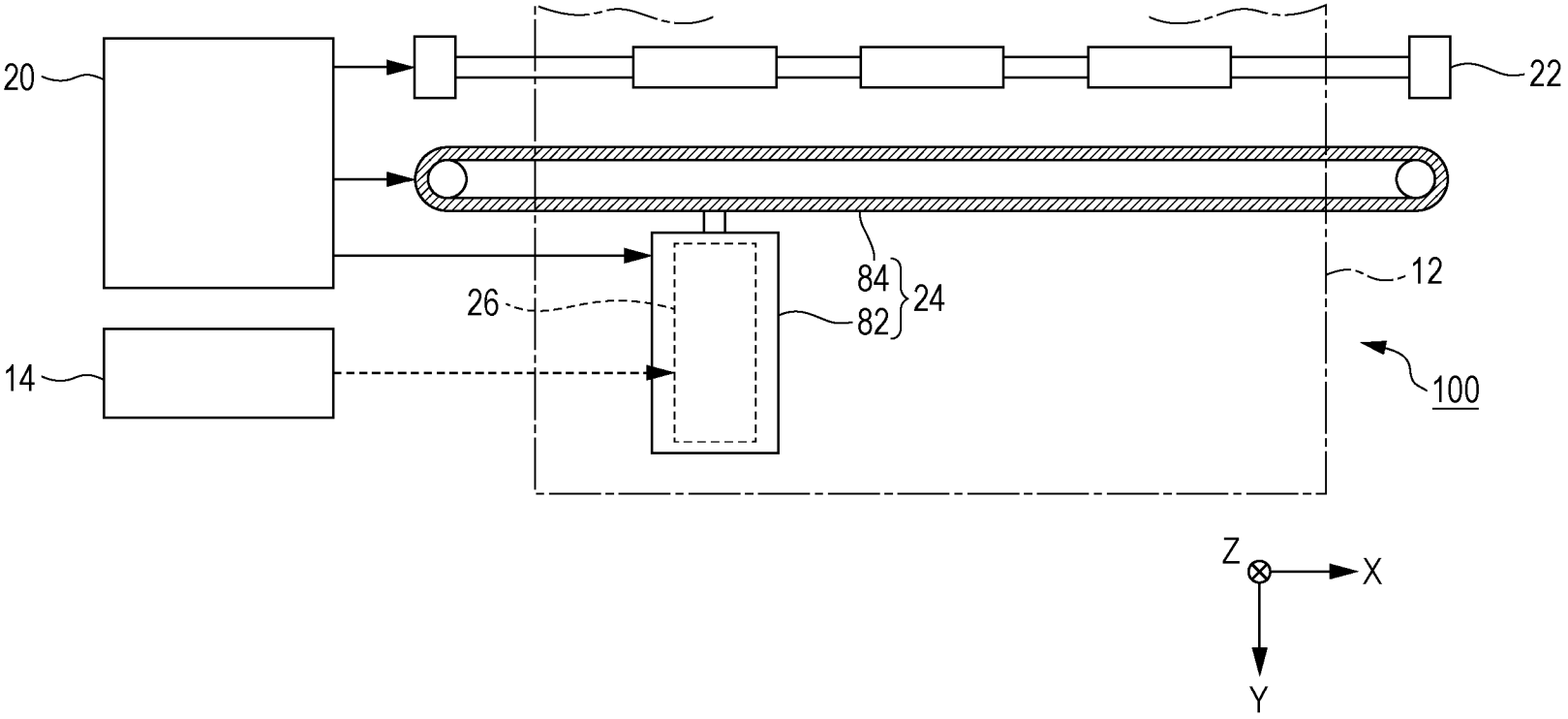
FIG. 1 is a block diagram illustrating a configuration of a liquid ejecting apparatus according to a first embodiment of the present disclosure.

FIG. 1 is a block diagram illustrating an example of a liquid ejecting apparatus 100 according to an embodiment of the present disclosure. The liquid ejecting apparatus 100 of the present exemplary embodiment is an ink jet printing apparatus that ejects ink, which is an example of a liquid, on a medium 12. While the medium 12 is typically printing paper, an object to be printed formed of any material, such as a resin film or fabric, is used as the medium 12. As illustrated as an example in FIG. 1, a liquid container 14 that stores ink is installed in the liquid ejecting apparatus 100. For example, a cartridge configured to detach from the liquid ejecting apparatus 100, a bag-shaped ink pack formed of flexible film, or an ink tank into which ink can be refilled is used as the liquid container 14. A plurality of types of inks of different colors are stored in the liquid container 14.

As illustrated as an example in FIG. 1, the liquid ejecting apparatus 100 includes a control unit 20, a transport mechanism 22, a moving mechanism 24, and a liquid ejecting head 26. The control unit 20 includes a processing circuit such as a central processing unit (CPU) or a field programmable gate array (FPGA) and a memory circuit such as a semiconductor memory, and controls each element of the liquid ejecting apparatus 100 in an integrated manner. The transport mechanism 22 transports the medium 12 in a Y-axis direction under the control of the control unit 20.

The moving mechanism 24 transports the liquid ejecting head 26 in an X-axis direction under the control of the control unit 20. The X-axis intersects the Y-axis along which the medium 12 is transported. Typically, the X-axis and the Y-axis are orthogonal to each other. The moving mechanism 24 of the present exemplary embodiment includes a substantially box-shaped transport body 82 that houses the liquid ejecting head 26, and a transport belt 84 to which the transport body 82 is fixed. Note that a configuration in which a plurality of liquid ejecting heads 26 are mounted in the transport body 82 or a configuration in which the liquid container 14 is mounted in the transport body 82 together with the liquid ejecting head 26 can be adopted.

Under the control of the control unit 20, the liquid ejecting head 26 ejects ink, which is supplied from the liquid container 14, onto the medium 12 through a plurality of nozzles. The control unit 20 generates various signals and voltages for ejecting ink from the nozzles and supplies the signals and voltages to the liquid ejecting head 26. The ink is ejected along a Z-axis. The Z-axis is an axis that is perpendicular to an XY plane. In other words, the X-axis and the Y-axis are orthogonal to the Z-axis. The Z-axis is an example of a "first axis", the Y-axis is an example of a "second axis", and the X-axis is an example of a "third axis". Concurrently with the transportation of the medium 12 performed with the transport mechanism 22 and the repetitive reciprocation of the transport body 82, the liquid ejecting head 26 ejects ink onto the medium 12 to form a desired image on a surface of the medium 12.

Figure 2:
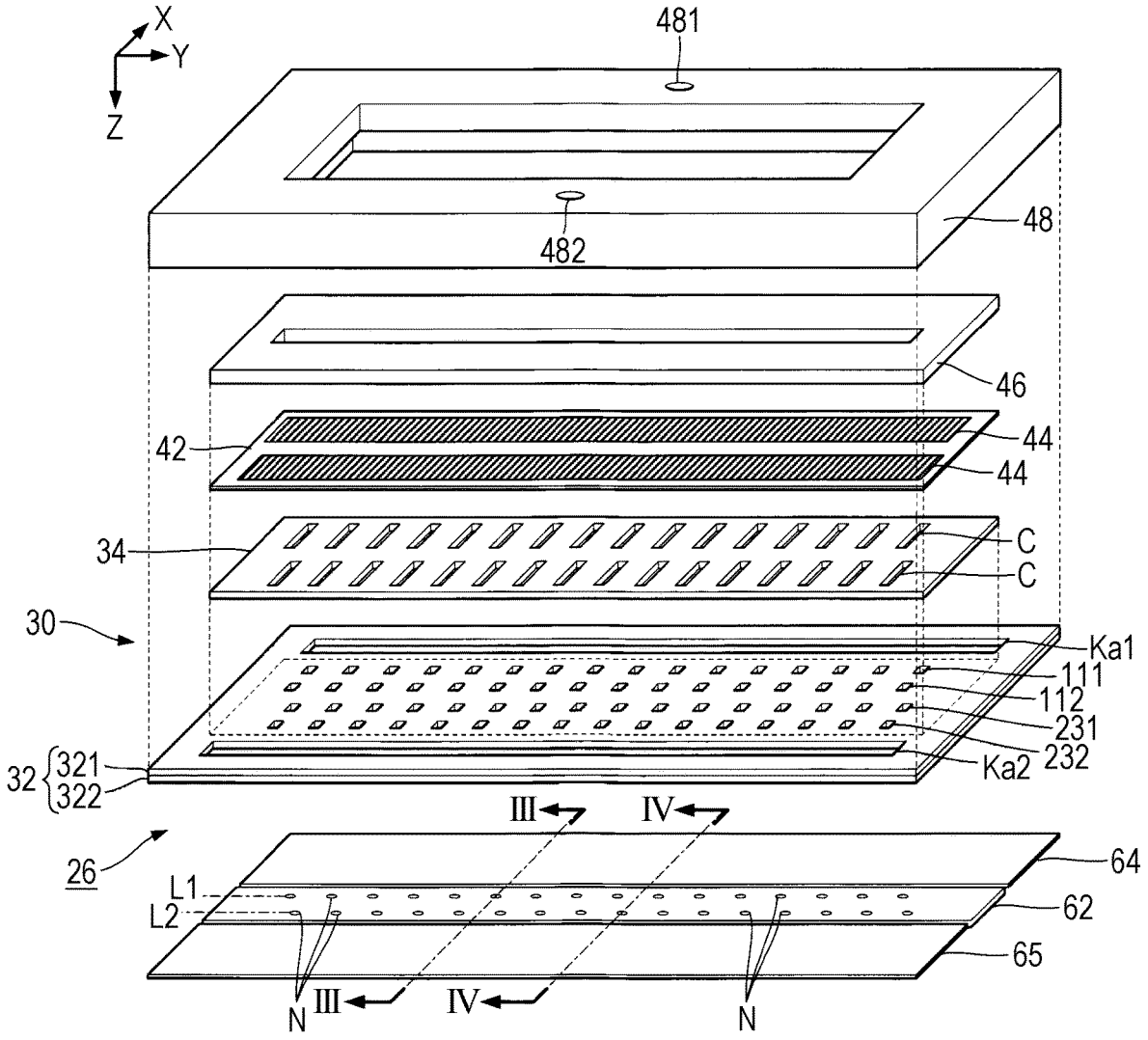
FIG. 2 is an exploded perspective view of a liquid ejecting head.

FIG. 2 is an exploded perspective view of the liquid ejecting head 26. As illustrated as an example in FIG. 2, the liquid ejecting head 26 includes a plurality of nozzles N arranged in the Y-axis direction. The plurality of nozzles N of the present exemplary embodiment are divided into a first line L1 and a second line L2 that are parallelly arranged with a space in between in the X-axis direction. The first line L1 and the second line L2 are each a set of a plurality of nozzles N linearly arranged in the Y-axis direction. As illustrated as an example in FIG. 2, positions of the nozzles N of the first line L1 and positions of the nozzles N of the second line L2 are different in the Y-axis. Specifically, when viewed in the X-axis direction, a single nozzle N of the second line L2 is positioned between two adjacent nozzles N of the first line L1.

Figure 3:
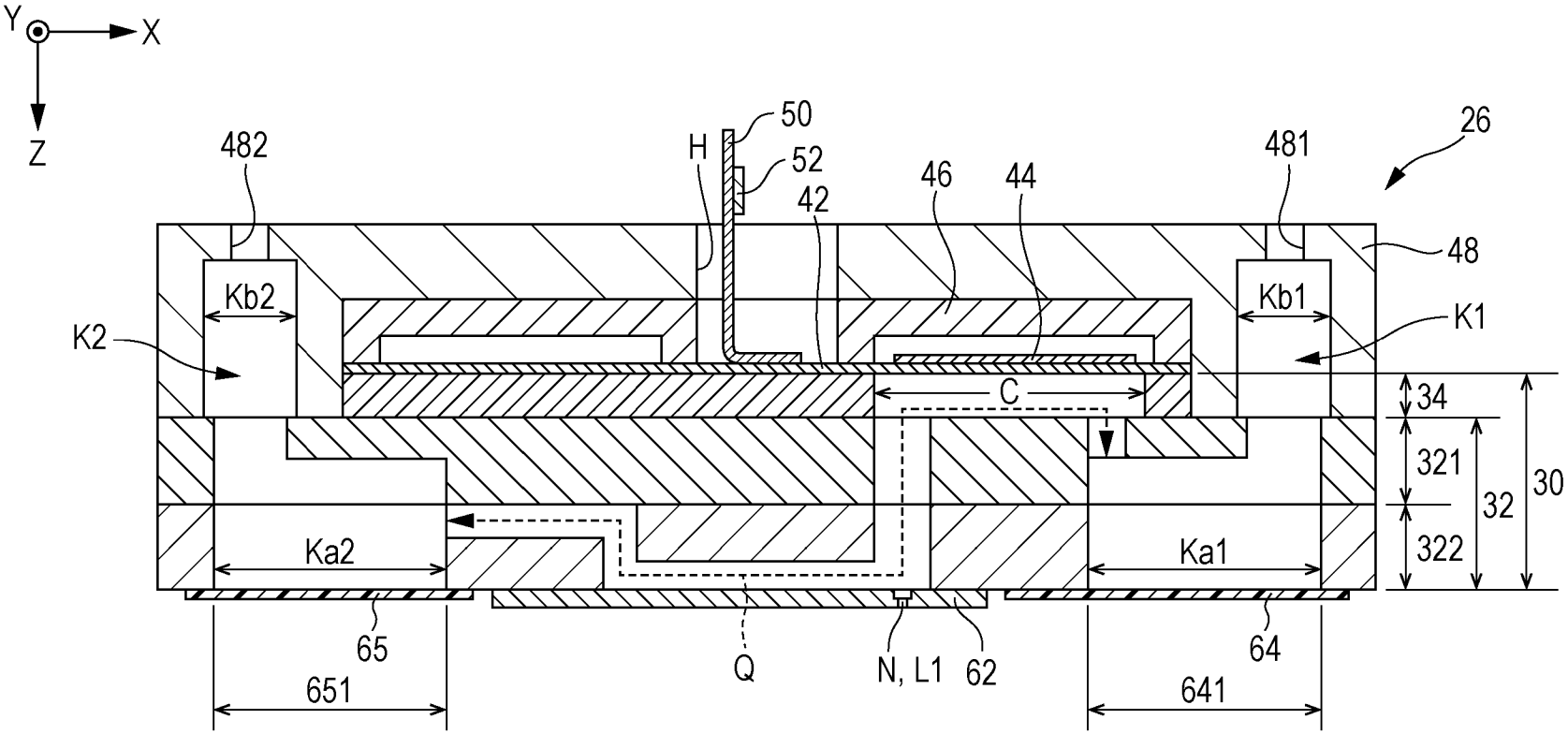
FIG. 3 is a cross-sectional view of the liquid ejecting head.
Figure 4:
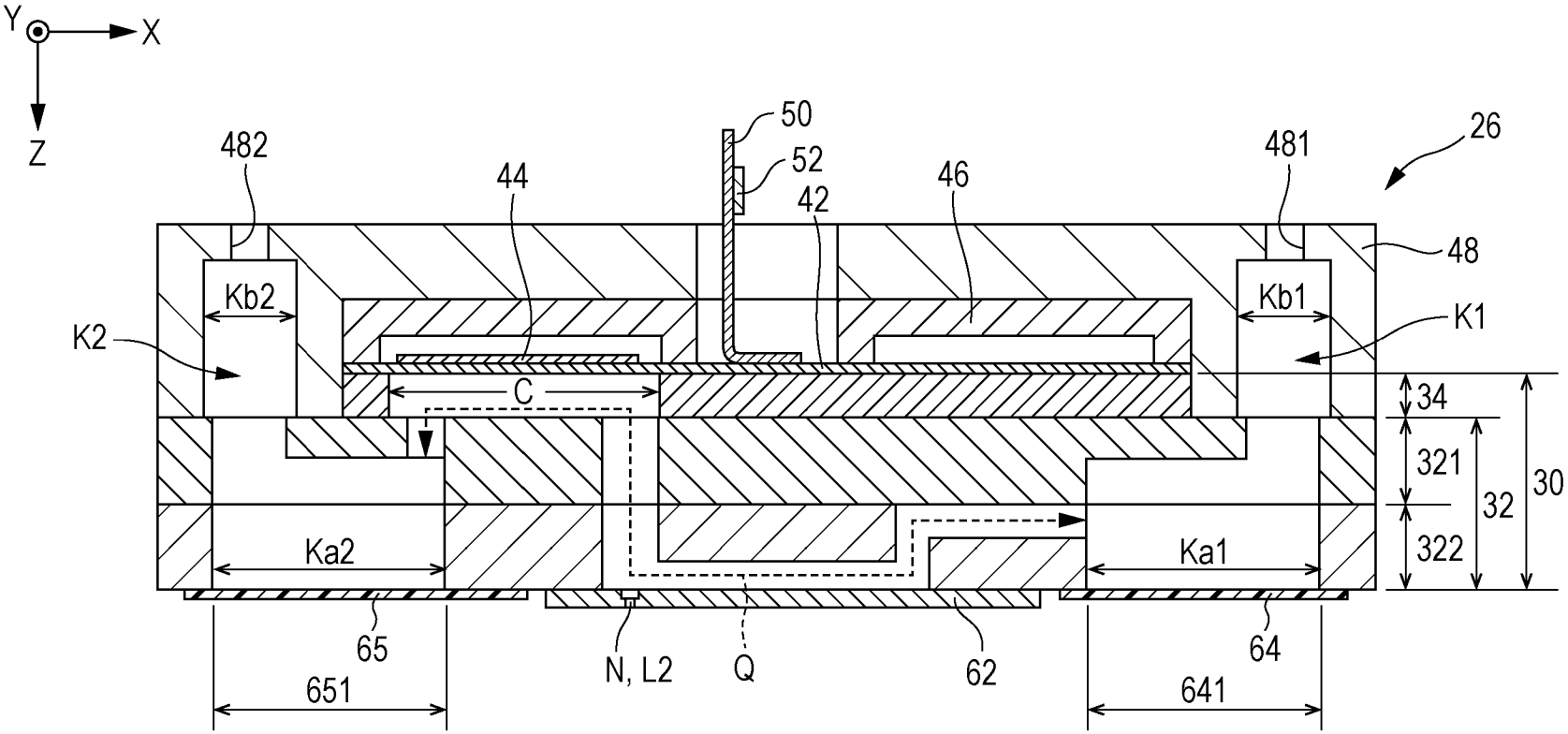
FIG. 4 is a cross-sectional view of the liquid ejecting head.

FIG. 3 is a cross-sectional view taken along line III-III in FIG. 2, and FIG. 4 is a cross-sectional view taken along line IV-IV in FIG. 2. FIG. 3 is a cross-sectional view of elements related to a single nozzle N in the first line L1, and FIG. 4 is a cross-sectional view of elements related to a single nozzle N in the second line L2. As it can be understood from FIGS. 3 and 4, the elements related to each nozzle N of the first line L1 and the elements related to each nozzle N of the second line L2 are in an inverted relationship with respect to a YZ plane.

As illustrated as an example in FIGS. 2 to 4, the liquid ejecting head 26 includes a flow path structure 30. The flow path structure 30 forms flow paths that supply ink to the nozzles N. As illustrated as an example in FIG. 2, a diaphragm 42, a protective substrate 46, and a housing portion 48 are provided on the negative side in the Z-axis direction with respect to the flow path structure 30. On the other hand, a nozzle plate 62, a first vibration absorber 64, and a second vibration absorber 65 are provided on the positive side in the Z-axis direction with respect to a flow path substrate 32. Generally, each element of the liquid ejecting head 26 is a plate-shaped member elongated along the Y-axis and is connected to each other using an adhesive agent, for example.

The nozzle plate 62 is a plate-shaped member in which a plurality of nozzles N are formed and is provided on a surface of the flow path structure 30 on the positive side in the Z-axis direction. Each of the plurality of nozzles N is a circular through hole through which ink passes. In the nozzle plate 62 of the present exemplary embodiment, the plurality of nozzles N constituting the first line L1 and the plurality of nozzles N constituting the second line L2 are formed. The nozzle plate 62 is manufactured by processing a single crystal substrate formed of silicon using a semiconductor manufacturing technique such as, for example, dry etching or wet etching. However, any known materials and any known manufacturing methods can be adopted to manufacture the nozzle plate 62.

As illustrated as an example in FIGS. 2 to 4, the flow path structure 30 includes the flow path substrate 32 and a pressure chamber substrate 34. The flow path substrate 32 is positioned on the positive side in the Z-axis direction in the flow path structure 30, and the pressure chamber substrate 34 is positioned on the negative side in the Z-axis direction in the flow path structure 30. As illustrated as an example in FIG. 2, a space Ka1 and a space Ka2 are formed in the flow path substrate 32. The space Ka1 and the space Ka2 are each an opening elongated along the Y-axis. The space Ka1 is formed, in the flow path substrate 32, on the positive side in the X-axis direction, and the space Ka2 is formed, in the flow path substrate 32, on the negative side in the X-axis direction.

The flow path substrate 32 of the present exemplary embodiment is formed of layers including a first substrate 321 and a second substrate 322. The first substrate 321 is positioned between the second substrate 322 and the pressure chamber substrate 34. As illustrated as an example in FIGS. 3 and 4, the space Ka1 is formed across the first substrate 321 and the second substrate 322. Similarly, the space Ka2 is formed across the first substrate 321 and the second substrate 322.

The housing portion 48 is a case for storing the ink. A space Kb1 corresponding to the space Ka1 and a space Kb2 corresponding to the space Ka2 are formed in the housing portion 48. The space Ka1 of the flow path structure 30 and the space Kb1 of the housing portion 48 are in communication with each other and the space Ka2 of the flow path structure 30 and space Kb2 of the housing portion 48 are in communication with each other. The space formed by the space Ka1 and the space Kb1 functions as a first common liquid chamber K1, and the space formed by space Ka2 and the space Kb2 functions as a second common liquid chamber K2. The first common liquid chamber K1 and the second common liquid chamber K2 are each a space commonly formed across a plurality of nozzles N and each store ink suppled to the plurality of nozzles N.

An introduction port 481 and a discharge port 482 are formed in the housing portion 48. The ink is supplied to the first common liquid chamber K1 through the introduction port 481. The ink inside the second common liquid chamber K2 is discharged through the discharge port 482. As illustrated as an example in FIGS. 3 and 4, the first vibration absorber 64 is a flexible film constituting a portion of the wall surface of the first common liquid chamber K1. The portion (hereinafter, referred to as a "first deforming portion 641") in the first vibration absorber 64 that becomes deformed in response to a pressure change of the ink inside the first common liquid chamber K1 is where the first vibration absorber 64 constitute the portion of the wall surface of the first common liquid chamber K1. In other words, a portion of the first vibration absorber 64 that is not fixed to a surface of the flow path substrate 32 is the first deforming portion 641. The first deforming portion 641 absorbs the pressure change of the ink inside the first common liquid chamber K1 by becoming deformed according to the pressure change inside the first common liquid chamber K1. As understood from the description above, the first common liquid chamber K1 includes the first deforming portion 641.

The second vibration absorber 65 is a flexible film constituting a portion of the wall surface of the second common liquid chamber K2. The portion (hereinafter, referred to as a "second deforming portion 651") in the second vibration absorber 65 that becomes deformed in response to a pressure change of the ink inside the second common liquid chamber K2 is where the second vibration absorber 65 constitute the portion of the wall surface of the second common liquid chamber K2. In other words, a portion of the second vibration absorber 65 that is not fixed to a surface of the flow path substrate 32 is the second deforming portion 651. The second deforming portion 651 absorbs the pressure change of the ink inside the second common liquid chamber K2 by becoming deformed according to the pressure change inside the second common liquid chamber K2. As understood from the description above, the second common liquid chamber K2 includes the second deforming portion 651.

Figure 5:
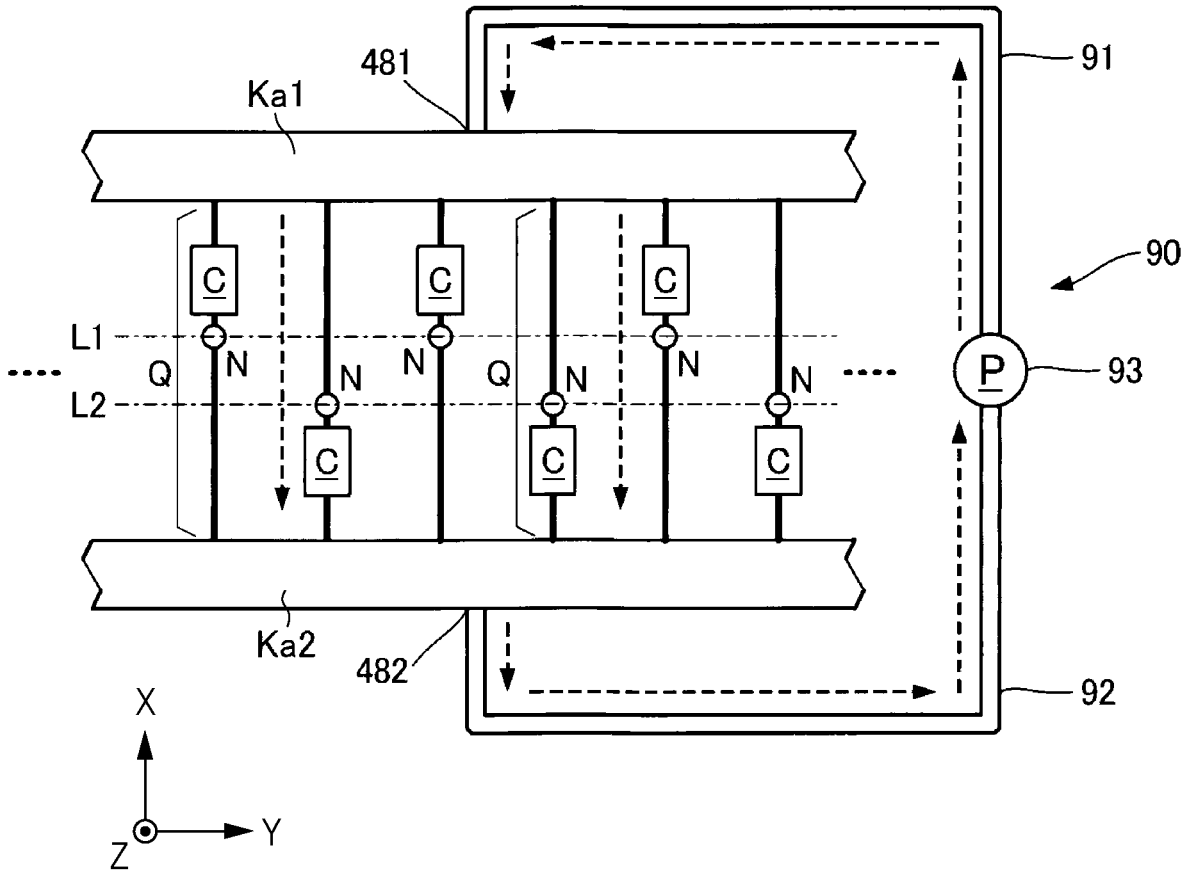
FIG. 5 is a schematic diagram of flow paths formed in the liquid ejecting head.

FIG. 5 is a schematic diagram of the flow paths formed in the liquid ejecting head 26. As illustrated as an example in FIG. 5, an individual flow path Q is formed for each nozzle N in the flow path structure 30. In other words, a plurality of individual flow paths Q are each formed for a corresponding one of a plurality of nozzles N. As illustrated as an example in FIGS. 3 and 4, the nozzles N are formed in the nozzle plate 62 in portions where the wall surfaces of the individual flow paths Q are formed. In other words, each nozzle N is formed so as to branch out from the corresponding individual flow path Q. The first common liquid chamber K1 and the second common liquid chamber K2 are in communication with each other through the individual flow paths Q. Specifically, the individual flow paths Q are formed so that the space Ka1 of the first common liquid chamber K1 and the space Kat of the second common liquid chamber K2 communicate with each other. The individual flow paths Q are flow paths formed from an inner wall surface of the first common liquid chamber K1 to an inner wall surface of the second common liquid chamber K2. The individual flow paths Q corresponding to the nozzles N of the first line L1 and the individual flow paths Q corresponding to the nozzles N of the second line L2 are in an inverted relationship with respect to the YZ plane.

As illustrated as an example in FIG. 5, the plurality of individual flow paths Q are arranged in parallel to each other and along the Y-axis. In other words, a row of individual flow paths that includes the plurality of individual flow paths Q are formed. Specifically, the individual flow paths Q corresponding to the nozzles N of the first line L1 and the individual flow paths Q corresponding to the nozzles N of the second line L2 are arranged alternately in the Y-axis direction. As understood from the description above, the plurality of individual flow paths Q are in communication with both the first common liquid chamber K1 and the second common liquid chamber K2. In the ink that is supplied to the individual flow paths Q from the first common liquid chamber K1, the ink that is not ejected through the nozzles N is stored in the second common liquid chamber K2.

As illustrated as an example in FIG. 5, the liquid ejecting apparatus 100 includes a circulation mechanism 90. The circulation mechanism 90 is a mechanism that recirculates the ink, which is to be discharged from the liquid ejecting head 26, to the liquid ejecting head 26. The circulation mechanism 90 is a mechanism that circulates the ink that is supplied to the liquid ejecting head 26 and includes, for example, a supply flow path 91, a discharge flow path 92, and a circulation pump 93.

The supply flow path 91 is a flow path that supplies the ink to the first common liquid chamber K1 and is coupled to the introduction port 481 of the first common liquid chamber K1. The discharge flow path 92 is a flow path that discharges the ink from the second common liquid chamber K2 and is coupled to the discharge port 482 of the second common liquid chamber K2. The circulation pump 93 is a pumping mechanism that sends the ink supplied through the discharge flow path 92 to the supply flow path 91. In other words, the ink discharged from the second common liquid chamber K2 is recirculated to the first common liquid chamber K1 through the discharge flow path 92, the circulation pump 93, and the supply flow path 91. As understood from the description above, the circulation mechanism 90 functions as an element that collects the ink from the second common liquid chamber K2 and that recirculates the collected ink to the first common liquid chamber K1. Note that a configuration in which the circulation mechanism 90 collects the ink from the first common liquid chamber K1 and that recirculates the ink to the second common liquid chamber K2 may be adopted as well.

As illustrated as an example in FIG. 5, each individual flow path Q includes a pressure chamber C. As illustrated as an example in FIG. 2, the pressure chambers C are formed in the pressure chamber substrate 34. The pressure chamber substrate 34 is a plate-shaped member in which the plurality of pressure chambers C are each formed for a corresponding one of the plurality of nozzles N. Each pressure chamber C is a space elongated along the X-axis in plan view. As illustrated as an example in FIGS. 2 and 3, the plurality of pressure chambers C corresponding to the nozzles N of the first line L1 are arranged in the Y-axis direction and in a portion in the pressure chamber substrate 34 on the positive side in the X-axis direction. As illustrated as an example in FIG. 4, the plurality of pressure chambers C corresponding to the nozzles N of the second line L2 are arranged in the Y-axis direction and in a portion in the pressure chamber substrate 34 on the negative side in the X-axis direction. Each pressure chamber C overlaps the corresponding nozzle N in plan view.

Similar to the nozzle plate 62 described above, the flow path substrate 32 and the pressure chamber substrate 34 are manufactured by processing a single crystal substrate formed of silicon using a semiconductor manufacturing technique, for example. However, any known materials and any known manufacturing methods can be adopted to manufacture the flow path substrate 32 and the pressure chamber substrate 34.

As illustrated as an example in FIG. 2, the diaphragm 42 is formed on a surface of the pressure chamber substrate 34 on a side opposite the flow path substrate 32. The diaphragm 42 of the present exemplary embodiment is a plate-shaped member configured to vibrate elastically. Note that portions or the entire diaphragm 42 can be formed so as to be integrated with the pressure chamber substrate 34 by selectively removing portions of a plate-shaped member, having a predetermined plate thickness, corresponding to the pressure chambers C in the plate thickness direction. The pressure chambers C are spaces located between the flow path substrate 32 and the diaphragm 42.

As illustrated as an example in FIGS. 2 to 4, energy generating portions 44 are formed on a surface of the diaphragm 42 on a side opposite the pressure chambers C. The energy generating portions 44 are each formed for a corresponding nozzle N. The plurality of energy generating portions 44 are each formed for a corresponding one of the plurality of nozzles N. Each energy generating portion 44 generates energy for ejecting ink. Specifically, the energy generating portions 44 are each a drive element that ejects ink through the corresponding nozzle N by changing the pressure inside the corresponding pressure chamber C. In the present exemplary embodiment, piezoelectric elements are used as the energy generating portions 44. The piezoelectric elements each change the volume of the corresponding pressure chamber C by deforming the diaphragm 42. In other words, each energy generating portion 44 generates a pressure for ejecting ink. Specifically, each energy generating portion 44 is an actuator that becomes deformed by having a drive signal supplied thereto and is formed so as to be elongated along the X-axis in plan view. The plurality of energy generating portions 44 are arranged in the Y-axis direction so as to correspond to the plurality of pressure chambers C. When the diaphragm 42 working together with the deformation of the energy generating portions 44 is vibrated, the pressure inside each pressure chamber C is changed, which ejects the ink filled in each pressure chamber C through the corresponding nozzle N.

The protective substrate 46 in FIG. 2 is a plate-shaped member that, while protecting the plurality of energy generating portions 44, reinforces the mechanical strength of the diaphragm 42. The protective substrate 46 is mounted on a side opposite the pressure chamber substrate 34 so that the protective substrate 46 and the pressure chamber substrate 34 interpose the diaphragm 42 in between. The plurality of energy generating portions 44 are mounted between the protective substrate 46 and the diaphragm 42. The protective substrate 46 is formed of silicon (Si), for example. As illustrated as an example in FIGS. 3 and 4, a wiring substrate 50, for example, is joined to a surface of the diaphragm 42. The wiring substrate 50 is a mounted component in which a plurality of wires that electrically couple the control unit 20 or a power supply circuit and the liquid ejecting head 26 to each other are formed. The flexible wiring substrate 50 such as, for example, a flexible printed circuit (FPC) or a flexible flat cable (FFC) is desirably used. A drive circuit 52 mounted on the wiring substrate 50 supplies a drive signal to each energy generating portion 44.

Figure 6:
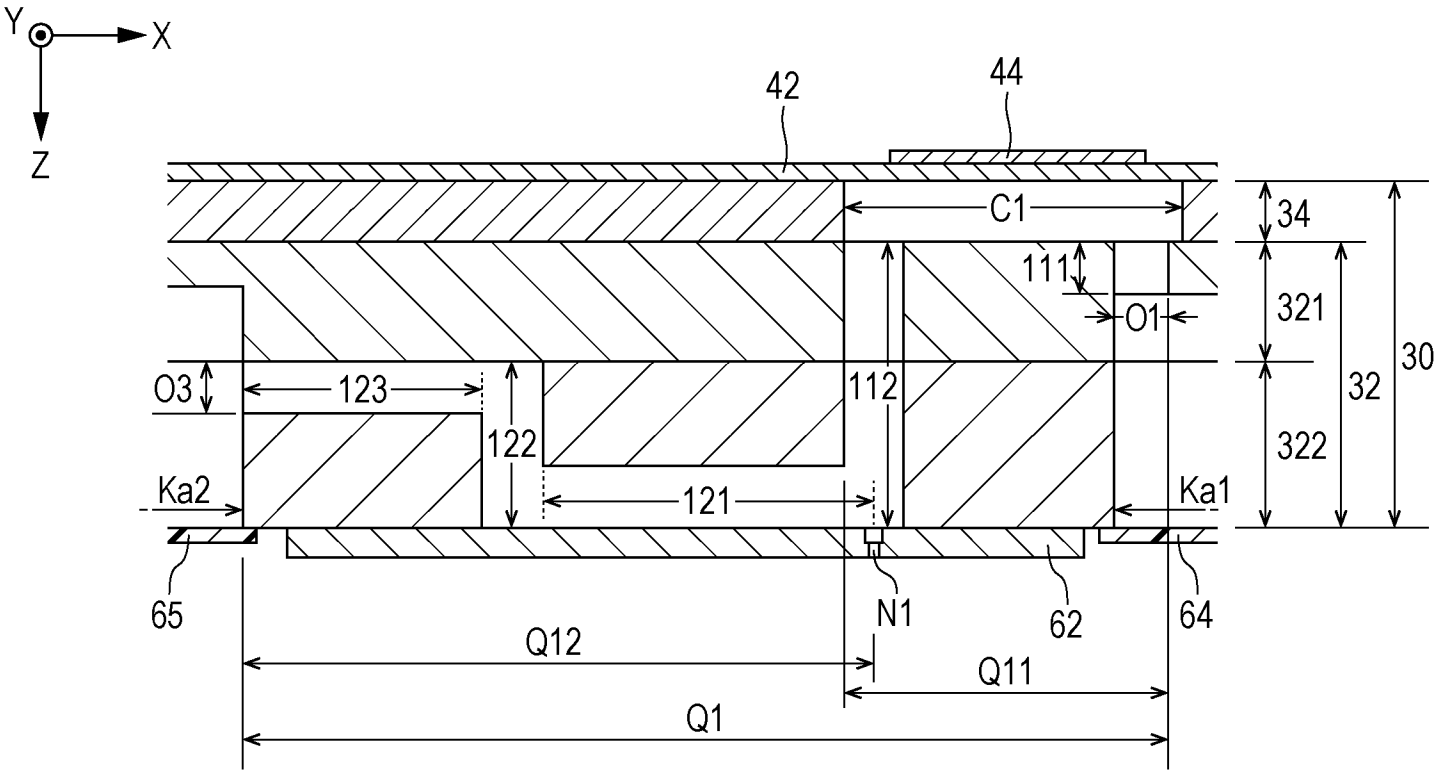
FIG. 6 is a cross-sectional view of a first individual flow path.
Figure 7:
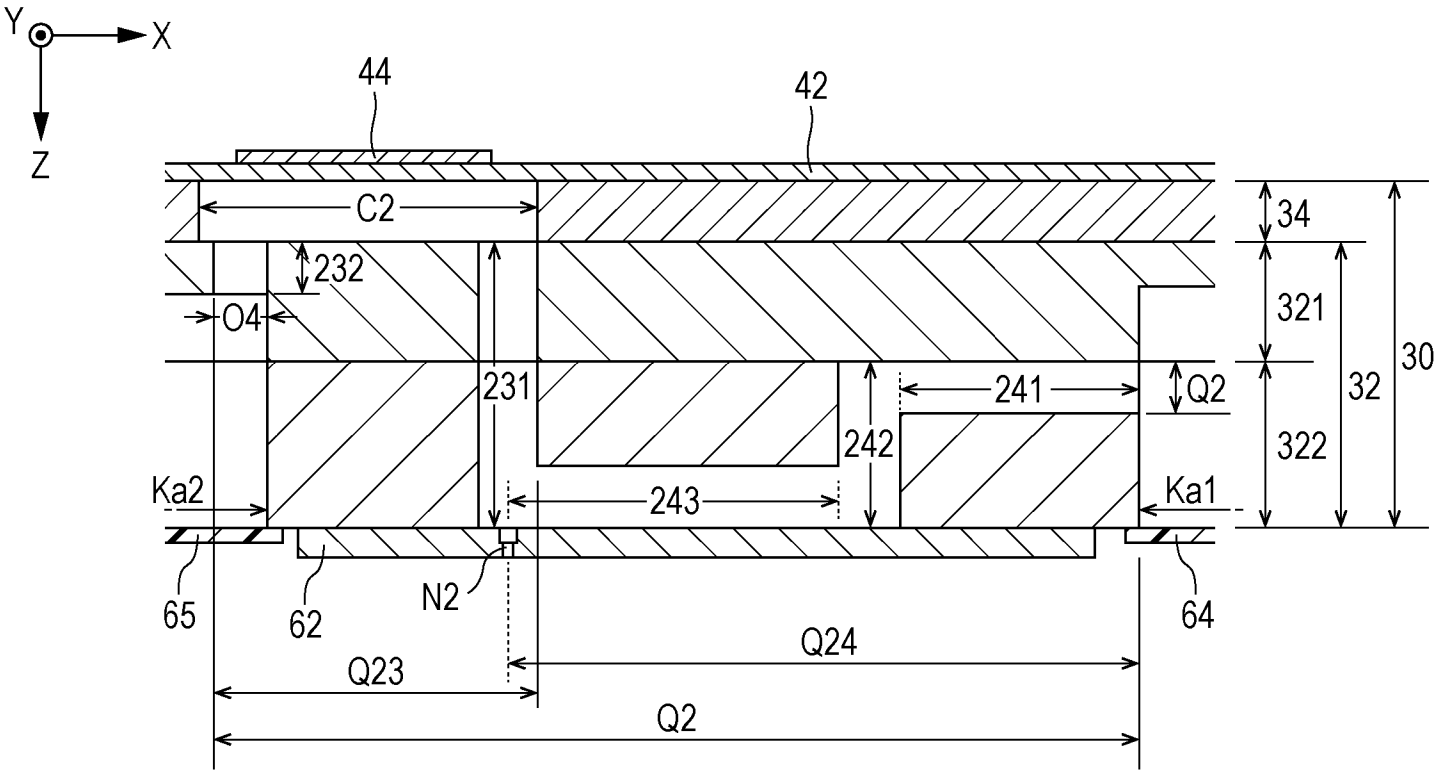
FIG. 7 is a cross-sectional view of a second individual flow path.

In the following description, between two individual flow paths Q adjacent to each other in the Y-axis direction, one is denoted as a "first individual flow path Q1" and the other is denoted as a "second individual flow path Q2". FIG. 6 is a cross-sectional view of the first individual flow path Q1 and FIG. 7 is a cross-sectional view of the second individual flow path Q2. FIG. 6 is an enlarged view of the individual flow path Q illustrated as an example in FIG. 3 and FIG. 7 is an enlarged view of the individual flow path Q illustrated as an example in FIG. 4.

The first individual flow path Q1 is an individual flow path Q corresponding to any single nozzle N (hereinafter, referred to as a "first nozzle N1") in the first line L1, and the second individual flow path Q2 is an individual flow path Q corresponding to any single nozzle N (hereinafter, referred to as a "second nozzle N2") in the second line L2. The first nozzle N1 and the second nozzle N2 are, among the plurality of nozzles N formed in the nozzle plate 62, two nozzles N adjacent to each other when viewed in the X-axis direction. Furthermore, among the plurality of pressure chambers C, the pressure chamber C corresponding to the first individual flow path Q1 is denoted as a "first pressure chamber C1", and among the plurality of pressure chambers C, the pressure chamber C corresponding to the second individual flow path Q2 is denoted as a "second pressure chamber C2". The first individual flow path Q1 and the second individual flow path Q2 are in an inverted relationship with respect to an XZ plane. Note that a flow path resistance R of the first individual flow path Q1 and a flow path resistance R of the second individual flow path Q2 are substantially the same.

As illustrated as an example in FIG. 6, a first opening O1 that is a connection port between the first individual flow path Q1 and the first common liquid chamber K1 is formed in a wall surface of the first common liquid chamber K1. It can also be said that an interface between the first common liquid chamber K1 and the first individual flow path Q1 is the first opening O1. On the other hand, a third opening O3 that is a connection port between the second common liquid chamber K2 and the first individual flow path Q1 is formed in a wall surface of the second common liquid chamber K2. It can also be said that an interface between the second common liquid chamber K2 and the first individual flow path Q1 is the third opening O3. As understood from the description above, a flow path from the first opening O1 to the third opening O3 is the first individual flow path Q1.

Furthermore, as illustrated as an example in FIG. 7, a second opening O2 that is a connection port between the second individual flow path Q2 and the first common liquid chamber K1 is formed in a wall surface of the first common liquid chamber K1. It can also be said that an interface between the first common liquid chamber K1 and the second individual flow path Q2 is the second opening O2. A fourth opening O4 that is a connection port between the second common liquid chamber K2 and the second individual flow path Q2 is formed in a wall surface of the second common liquid chamber K2. It can also be said that an interface between the second common liquid chamber K2 and the second individual flow path Q2 is the fourth opening O4. As understood from the description above, a flow path from the second opening O2 to the fourth opening O4 is the second individual flow path Q2.

As illustrated as an example in FIG. 6, the first individual flow path Q1 includes a first communication flow path Q11 and a second communication flow path Q12. The first communication flow path Q11 allows the first common liquid chamber K1 and the first nozzle N1 to communicate with each other. Specifically, the first communication flow path Q11 is a flow path from the first opening O1 formed in the wall surface of the space Ka1 to an opening of the first nozzle N1 on the negative side in the Z-axis direction. The first communication flow path Q11 of the present exemplary embodiment includes a first flow path 111, the first pressure chamber C1, and a second flow path 112. The first flow path 111 allows the space Ka1 and the first pressure chamber C1 to communicate with each other. Specifically, the first flow path 111 is a through hole formed in the first substrate 321 and along the Z-axis. The first pressure chamber C1 allows the first flow path 111 and the second flow path 112 to communicate with each other. As described above, the first pressure chamber C1 is a space that is elongated along the X-axis and that is formed in the pressure chamber substrate 34. The energy generating portion 44 corresponding to the first nozzle N1 is mounted on a surface of the diaphragm 42 on a side opposite the first pressure chamber C1. It can also be said that the energy generating portion 44 corresponding to the first nozzle N1 is provided midway of the first individual flow path Q1. Note that the energy generating portion 44 corresponding to the first nozzle N1 is an example of a "first energy generating portion". The second flow path 112 allows the first pressure chamber C1 and the first nozzle N1 to communicate with each other. Specifically, the second flow path 112 is a through hole formed along the Z-axis and across the first substrate 321 and the second substrate 322.

The first pressure chamber C1 is in communication with the first common liquid chamber K1 through the first flow path 111 and is in communication with the first nozzle N1 through the second flow path 112. Accordingly, the ink filled in the first pressure chamber C1 from the first common liquid chamber K1 through the first flow path 111 passes through the second flow path 112 and is ejected through the first nozzle N1 with the deformation of the energy generating portion 44 corresponding to the first pressure chamber C1.

The second communication flow path Q12 allows the second common liquid chamber K2 and the first nozzle N1 to communicate with each other. Specifically, the second communication flow path Q12 is a flow path from a plane that includes a central axis of the first nozzle N1 and that is parallel to the YZ plane to the third opening O3 formed in a lateral surface of the space Kat. The second communication flow path Q12 of the present exemplary embodiment includes a third flow path 121, a fourth flow path 122, and a fifth flow path 123. The third flow path 121 allows the first nozzle N1 and the fourth flow path 122 to communicate with each other. Specifically, the third flow path 121 is formed along the X-axis and in a surface of the second substrate 322 on the positive side in the Z-axis direction. The fourth flow path 122 allows the third flow path 121 and the fifth flow path 123 to communicate with each other. Specifically, the fourth flow path 122 is a through hole formed in the second substrate 322 and along the Z-axis. The fifth flow path 123 allows the fourth flow path 122 and the second common liquid chamber K2 to communicate with each other. Specifically, the fifth flow path 123 is formed along the X-axis and in a surface of the second substrate 322 on the negative side in the Z-axis direction. In the ink that is supplied to the first individual flow path Q1 from the first common liquid chamber K1, the ink that is not ejected through the first nozzle N1 is stored in the second common liquid chamber K2.

As illustrated as an example in FIG. 7, the second individual flow path Q2 includes a third communication flow path Q23 and a fourth communication flow path Q24. The third communication flow path Q23 corresponds to the first communication flow path Q11, and the fourth communication flow path Q24 corresponds to the second communication flow path Q12. The first communication flow path Q11 and the fourth communication flow path Q24 are provided alternately along the Y-axis and on the positive side in the X-axis direction. The second communication flow path Q12 and the third communication flow path Q23 are provided alternately along the Y-axis and on the negative side in the X-axis direction.

The fourth communication flow path Q24 allows the first common liquid chamber K1 and the second nozzle N2 to communicate with each other. Specifically, the fourth communication flow path Q24 is a flow path from the second opening O2 formed in a lateral surface of the space Ka1 to a plane that includes a central axis of the second nozzle N2 and that is parallel to the YZ plane. The fourth communication flow path Q24 of the present exemplary embodiment includes a sixth flow path 241, a seventh flow path 242, and an eighth flow path 243. The sixth flow path 241 couples the first common liquid chamber K1 and the seventh flow path 242 to each other. Specifically, the sixth flow path 241 is formed along the X-axis and in a surface of the second substrate 322 on the negative side in the Z-axis direction. The seventh flow path 242 couples the sixth flow path 241 and the eighth flow path 243 to each other. Specifically, the seventh flow path 242 is a through hole formed in the second substrate 322 and along the Z-axis. The eighth flow path 243 allows the seventh flow path 242 and the second nozzle N2 to communicate with each other. Specifically, the eighth flow path 243 is formed along the X-axis and in a surface of the second substrate 322 on the positive side in the Z-axis direction.

The third communication flow path Q23 is a flow path that allows the second common liquid chamber K2 and the second nozzle N2 to communicate with each other. Specifically, the third communication flow path Q23 is a flow path from an opening of the second nozzle N2 on the negative side in the Z-axis direction to the fourth opening O4 formed in an upper surface of the space Kat. The third communication flow path Q23 of the present exemplary embodiment includes a ninth flow path 231, the second pressure chamber C2, and a tenth flow path 232. The ninth flow path 231 couples the second nozzle N2 and the second pressure chamber C2 to each other. Specifically, the ninth flow path 231 is a through hole formed along the Z-axis and across the first substrate 321 and the second substrate 322. The second pressure chamber C2 allows the ninth flow path 231 and the tenth flow path 232 to communicate with each other. As described above, the second pressure chamber C2 is a space that is elongated along the X-axis and that is formed in the pressure chamber substrate 34. The energy generating portion 44 corresponding to the second nozzle N2 is mounted on a surface of the diaphragm 42 on a side opposite the second pressure chamber C2. It can also be said that the energy generating portion 44 corresponding to the second nozzle N2 is provided midway of the second individual flow path Q2. Note that the energy generating portion 44 corresponding to the second nozzle N2 is an example of a "second energy generating portion". The tenth flow path 232 allows the second pressure chamber C2 and the space Kat to communicate with each other. Specifically, the tenth flow path 232 is a through hole formed in the first substrate 321 and along the Z-axis.

The ink is filled into the second pressure chamber C2 from the first common liquid chamber K1 through the fourth communication flow path Q24 and the ninth flow path 231. The ink inside the second pressure chamber C2 is ejected through the second nozzle N2 via the ninth flow path 231 with the deformation of the energy generating portion 44. In the ink that is supplied to the second individual flow path Q2 from the first common liquid chamber K1, the ink that is not ejected through the second nozzle N2 is stored in the second common liquid chamber K2.

Figure 8:
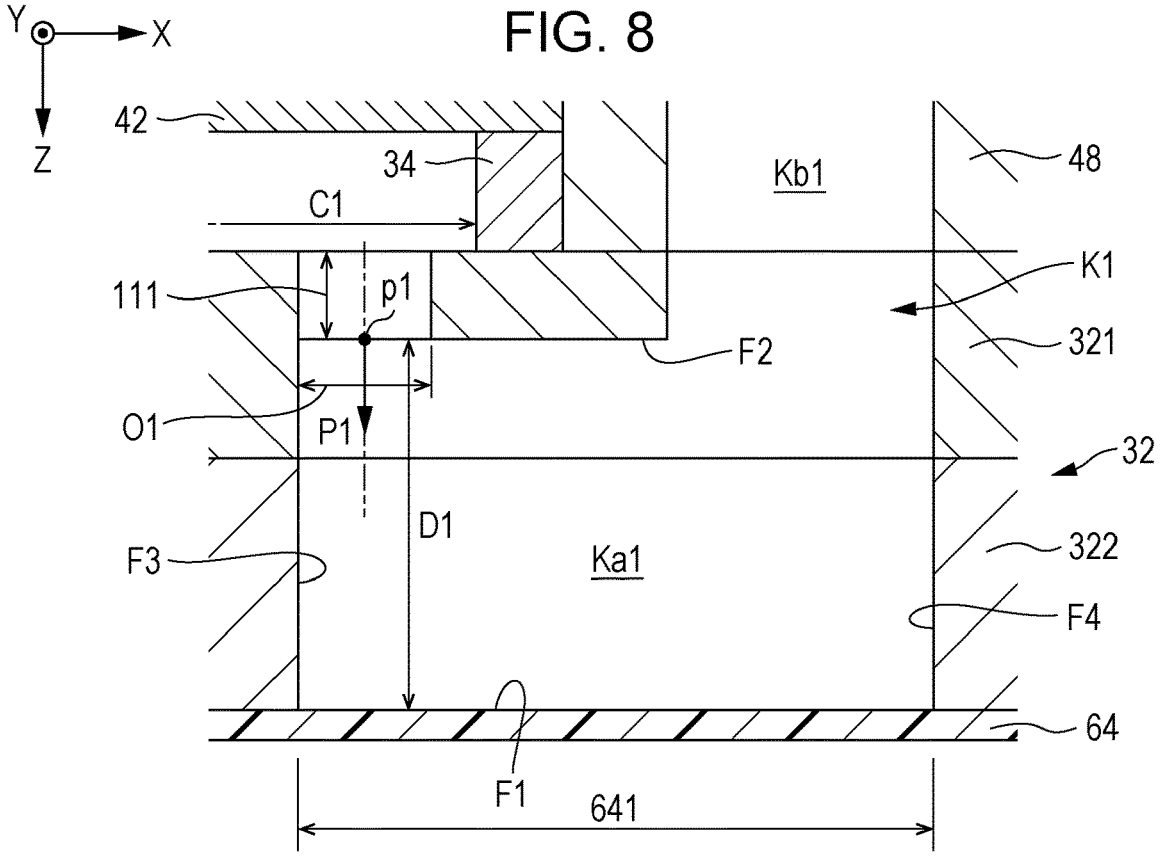
FIG. 8 is a cross-sectional view of a first common liquid chamber on a first individual flow path side.
Figure 9:
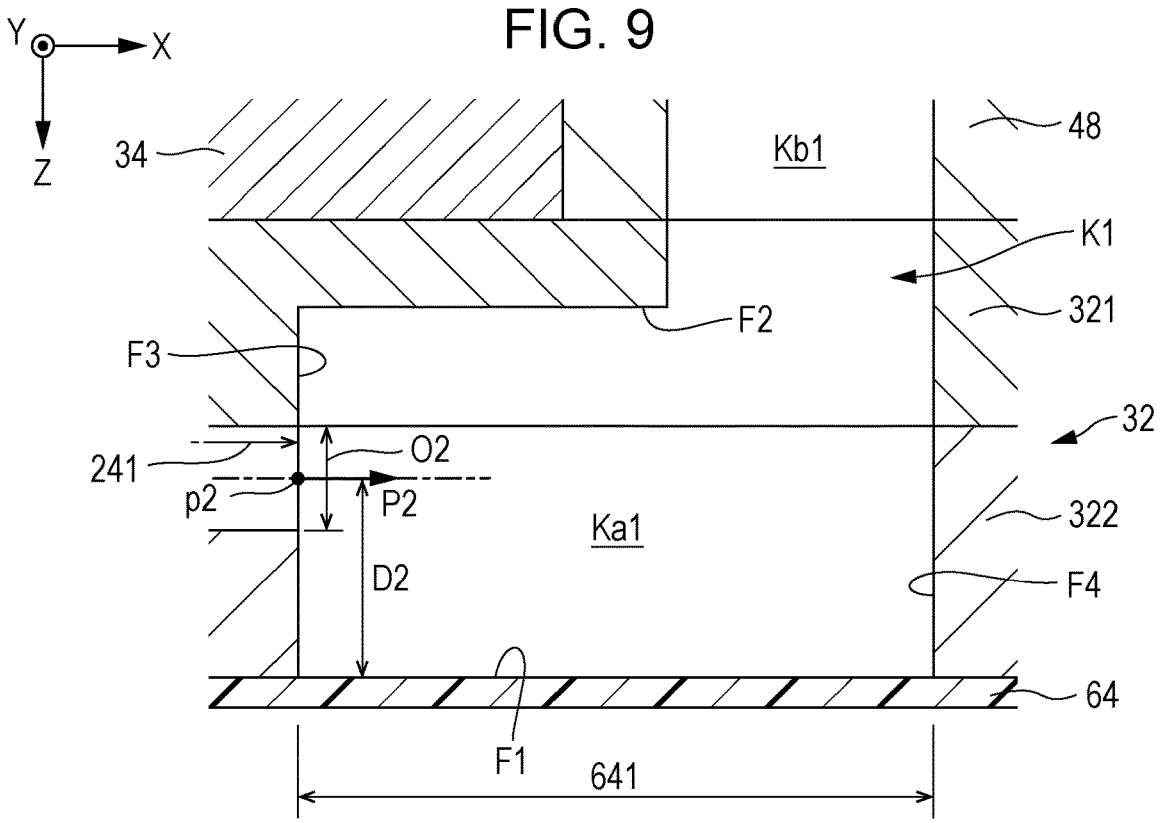
FIG. 9 is a cross-sectional view of the first common liquid chamber on a second individual flow path side.
Figure 10:
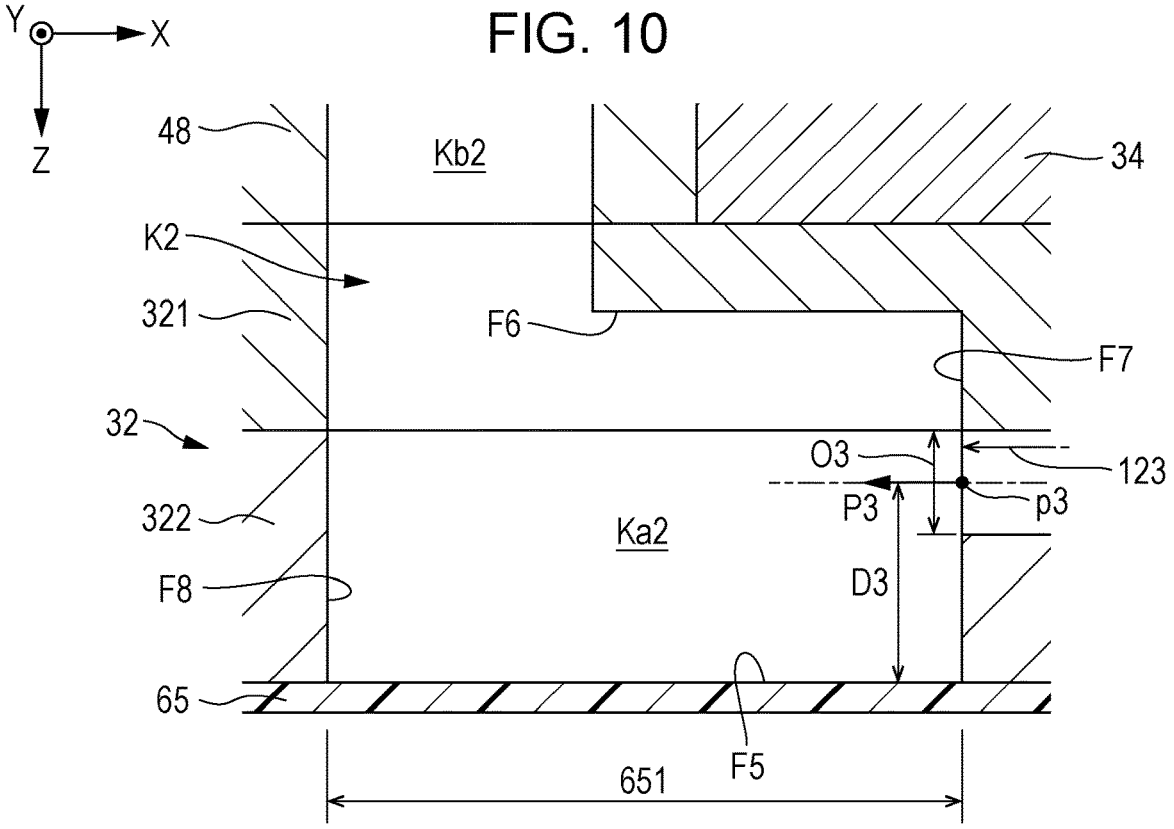
FIG. 10 is a cross-sectional view of a second common liquid chamber on the first individual flow path side.
Figure 11:
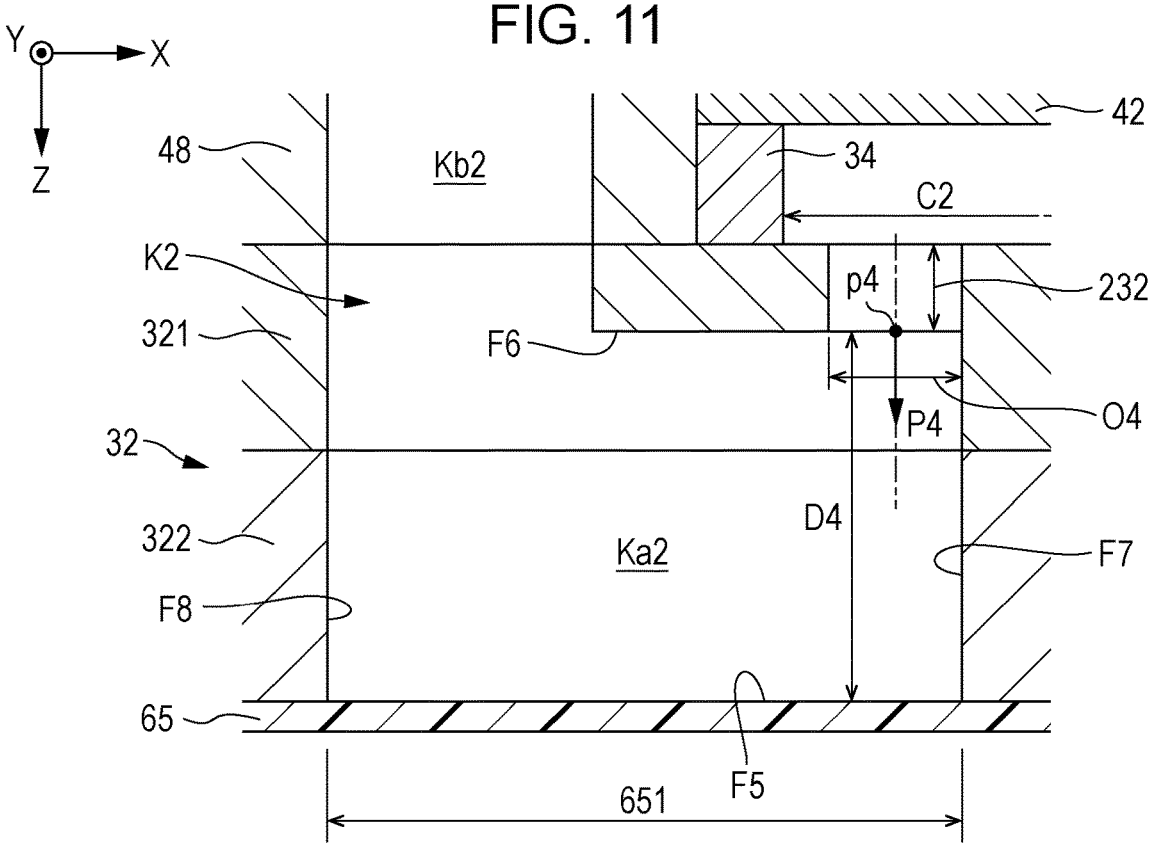
FIG. 11 is a cross-sectional view of the second common liquid chamber on the second individual flow path side.

The first opening O1, the second opening O2, the third opening O3, and the fourth opening O4 will be described below in detail. FIG. 8 is a cross-sectional view of the first common liquid chamber K1 on the first individual flow path Q1 side, and FIG. 9 is a cross-sectional view of the first common liquid chamber K1 on the second individual flow path Q2 side. Furthermore, FIG. 10 is a cross-sectional view of the second common liquid chamber K2 on the first individual flow path Q1 side, and FIG. 11 is a cross-sectional view of the second common liquid chamber K2 on the second individual flow path Q2 side.

As illustrated as an example in FIGS. 8 and 9, the first common liquid chamber K1 includes a first surface F1, a second surface F2, a third surface F3, and a fourth surface F4. The first surface F1, the second surface F2, the third surface F3, and the fourth surface F4 constitute wall surfaces of the first common liquid chamber K1. The first surface F1 is a bottom surface of the space Ka1. It can also be said that the first surface F1 is, among the wall surfaces of the space Ka1, the portion that is on the positive side in the Z-axis direction and that extends along the Y-axis. Specifically, the entire first surface F1 is constituted by the first deforming portion 641. Note that it is only sufficient that at least a portion of the first surface F1 is constituted by the first deforming portion 641. For example, the first deforming portion 641 and the flow path substrate 32 may constitute the first surface F1. The second surface F2 is an upper surface of the space Ka1. It can also be said that the second surface F2 is, among the wall surfaces of the space Ka1, the portion that is on the negative side in the Z-axis direction and that extends along the Y-axis. In other words, the first surface F1 and the second surface F2 oppose each other. Specifically, the second surface F2 is constituted by the flow path substrate 32.

The third surface F3 and the fourth surface F4 are portions of the lateral surfaces of the space Ka1. In other words, the third surface F3 and the fourth surface F4 are surfaces that intersect the first surface F1 and the second surface F2. In the present exemplary embodiment, the third surface F3 and the fourth surface F4 are orthogonal to the first surface F1 and the second surface F2. Specifically, the third surface F3 is, among the lateral surfaces of the space Ka1, the portion that is on the negative side in the X-axis direction and that extends along the Y-axis. On the other hand, the fourth surface F4 is, among the lateral surfaces of the space Ka1, the portion that is on the positive side in the X-axis direction and that extends along the Y-axis. In other words, the third surface F3 and the fourth surface F4 oppose each other. The third surface F3 and the fourth surface F4 are constituted by the flow path substrate 32.

As illustrated as an example in FIG. 8, the first opening O1 is provided in the second surface F2. In other words, the first opening O1 opposes the first deforming portion 641. An opening parallel to the XY plane is the first opening O1. As illustrated as an example in FIG. 9, the second opening O2 is provided in the third surface F3. In other words, the second opening O2 opposes the fourth surface F4. An opening that is parallel to the YZ plane is the second opening O2. As understood from the description above, the first opening O1 and the second opening O2 are not parallel to each other.

As illustrated as an example in FIGS. 8 and 9, the positions of the first opening O1 and the second opening O2 are different in the Z-axis direction. It can also be said that the heights of the first opening O1 and the second opening O2 are different. The position of the first opening O1 in the Z-axis direction is, for example, a position of a center of gravity p1 of the first opening O1 in the Z-axis direction. The position of the second opening O2 in the Z-axis direction is, for example, a position of a center of gravity p2 of the second opening O2 in the Z-axis direction. Specifically, the first opening O1 is positioned on the negative side in the Z-axis direction with respect to the second opening O2. It can also be said that the first opening O1 is closer to the pressure chamber substrate 34 than the second opening O2. In other words, the first opening O1 is positioned higher than the second opening O2.

A distance D1 between the first opening O1 and the first deforming portion 641 and a distance D2 between the second opening O2 and the first deforming portion 641 are different. The distance D1 is, for example, the shortest distance between the center of gravity p1 of the first opening O1 and a surface of the first deforming portion 641 on the negative side in the Z-axis direction. The distance D2 is, for example, the shortest distance between the center of gravity p2 of the second opening O2 and a surface of the first deforming portion 641 on the negative side in the Z-axis direction. Specifically, the distance D1 is larger than the distance D2. In other words, the first opening O1 is farther away from the first deforming portion 641 than the second opening O2.

Furthermore, a direction P1 of the first opening O1 and a direction P2 of the second opening O2 are different. The direction P1 of the first opening O1 is a direction of the normal line of the first opening O1. It can also be said that the direction of a central axis of the first flow path 111 is the direction P1 of the first opening O1. Similarly, the direction P2 of the second opening O2 is a direction of the normal line of the second opening O2. It can also be said that a direction of a central axis of the sixth flow path 241 is the direction P2 of the second opening O2. Specifically, the direction P1 of the first opening O1 is a direction extending along the Z-axis, and the direction P2 of the second opening O2 is a direction extending along the X-axis. In other words, an angle formed between the direction P1 of the first opening O1 and the direction P2 of the second opening O2 is 90 degrees.

As illustrated as an example in FIGS. 10 and 11, the second common liquid chamber K2 includes a fifth surface F5, a sixth surface F6, a seventh surface F7, and an eighth surface F8. The fifth surface F5, the sixth surface F6, the seventh surface F7, and the eighth surface F8 constitute wall surfaces of the second common liquid chamber K2. The fifth surface F5 is a bottom surface of the space Ka2. It can also be said that the fifth surface F5 is, among the wall surfaces of the space Ka2, the portion that is on the positive side in the Z-axis direction. Specifically, the entire fifth surface F5 is constituted by the second deforming portion 651. Note that it is only sufficient that at least a portion of the fifth surface F5 is constituted by the second deforming portion 651. For example, the second deforming portion 651 and the flow path substrate 32 may constitute the fifth surface F5. The sixth surface F6 is an upper surface of the space Ka2. It can also be said that the sixth surface F6 is, among the wall surfaces of the space Ka2, the portion that is on the negative side in the Z-axis direction. Specifically, the sixth surface F6 is constituted by the flow path substrate 32. The fifth surface F5 and the sixth surface F6 oppose each other.

The seventh surface F7 and the eighth surface F8 are portions of the lateral surfaces of the space Ka2. In other words, the seventh surface F7 and the eighth surface F8 are surfaces that intersect the fifth surface F5 and the sixth surface F6. In the present exemplary embodiment, the seventh surface F7 and the eighth surface F8 are orthogonal to the fifth surface F5 and the sixth surface F6. Specifically, the seventh surface F7 is, among the lateral surfaces of the space Ka2, the portion that is on the positive side in the X-axis direction and that extends along the Y-axis. On the other hand, the eighth surface F8 is, among the lateral surfaces of the space Kat, the portion that is on the negative side in the X-axis direction and that extends along the Y-axis. In other words, the seventh surface F7 and the eighth surface F8 oppose each other. The seventh surface F7 and the eighth surface F8 are constituted by the flow path substrate 32.

As illustrated as an example in FIG. 10, the third opening O3 is provided in the seventh surface F7. In other words, the third opening O3 opposes the eighth surface F8. An opening that is parallel to the YZ plane is the third opening O3. As illustrated as an example in FIG. 11, the fourth opening O4 is provided in the sixth surface F6. In other words, the fourth opening O4 opposes the second deforming portion 651. An opening parallel to the XY plane is the fourth opening O4. As understood from the description above, the third opening O3 and the fourth opening O4 are not parallel to each other.

As illustrated as an example in FIGS. 10 and 11, the positions of the third opening O3 and the fourth opening O4 are different in the Z-axis direction. It can also be said that the heights of the third opening O3 and the fourth opening O4 are different. The position of the third opening O3 in the Z-axis direction is, for example, a position of a center of gravity p3 of the third opening O3 in the Z-axis direction. The position of the fourth opening O4 in the Z-axis direction is, for example, a position of a center of gravity p4 of the fourth opening O4 in the Z-axis direction. Specifically, the fourth opening O4 is positioned on the negative side in the Z-axis direction with respect to the third opening O3. It can also be said that the fourth opening O4 is closer to the pressure chamber substrate 34 than the third opening O3. In other words, the fourth opening O4 is positioned higher than the third opening O3.

A distance D3 between the third opening O3 and the second deforming portion 651 and a distance D4 between the fourth opening O4 and the second deforming portion 651 are different. The distance D4 is, for example, the shortest distance between the center of gravity p4 of the fourth opening O4 and a surface of the second deforming portion 651 on the negative side in the Z-axis direction. The distance D3 is, for example, the shortest distance between the center of gravity p3 of the third opening O3 and a surface of the second deforming portion 651 on the negative side in the Z-axis direction. Specifically, the distance D4 is larger than the distance D3. In other words, the fourth opening O4 is farther away from the second deforming portion 651 than the third opening O3.

Furthermore, a direction P3 of the third opening O3 and a direction P4 of the fourth opening O4 are different. The direction P3 of the third opening O3 is a direction of the normal line of the third opening O3. It can also be said that the direction P3 of the third opening O3 is a direction of a central axis of the fifth flow path 123. Similarly, the direction P4 of the fourth opening O4 is a direction of the normal line of the fourth opening O4. It can also be said that the direction P4 of the fourth opening O4 is a direction of a central axis of the tenth flow path 232. Specifically, the direction P3 of the third opening O3 is a direction extending along the X-axis, and the direction P4 of the fourth opening O4 is a direction extending along the Z-axis. In other words, an angle formed between the direction P3 of the third opening O3 and the direction P4 of the fourth opening O4 is 90 degrees.

As described above, the first individual flow path Q1 and the second individual flow path Q2 are in an inverted relationship. Accordingly, as illustrated as an example in FIGS. 8 and 11, the positions of the first opening O1 and the fourth opening O4 are the same in the Z-axis direction. Furthermore, the direction P1 of the first opening O1 and the direction P4 of the fourth opening O4 are the same. In other words, the first opening O1 and the fourth opening O4 are parallel to each other. Furthermore, as illustrated as an example in FIGS. 9 and 10, the positions of the second opening O2 and the third opening O3 are the same in the Z-axis direction. Furthermore, the second opening O2 and the third opening O3 are parallel to each other. Specifically, the direction P2 of the second opening O2 and the direction P3 of the third opening O3 extend in opposite directions.

A description of crosstalk between adjacent individual flow paths Q will be given next. Crosstalk includes crosstalk caused in a mechanical manner through the structure constituting the flow paths, and crosstalk caused in a hydrodynamic manner through the liquid inside the flow paths. The latter crosstalk is greatly affected by the behavior of the liquid inside the common liquid chambers K (K1 and K2), which are portions where the adjacent individual flow paths Q are fluidly coupled to each other. For example, when distances between fluxes occurring near the openings O (O1, O2, O3, O4) are small and when the directions of the fluxes are close to each other, the effect exerted between the fluxes becomes large and the crosstalk becomes large. Furthermore, as the absorption and the attenuation of the change in pressure propagated into the common liquid chamber K through the openings O become smaller, the crosstalk becomes larger.

As understood from the description above, since the positions of the first opening O1 and the second opening O2 in the Z-axis direction are different in the present exemplary embodiment, when compared with a configuration in which the positions of the first opening O1 and the second opening O2 are the same in the Z-axis direction, for example, the distance between the first opening O1 and the second opening O2 can be large. In other words, the distance between the flux occurring near the first opening O1 and the flux occurring near the second opening O2 is larger. As a result, the flux occurring near the first opening O1 and the flux occurring near the second opening O2 do not easily affect each other. Accordingly, crosstalk between the first individual flow path Q1 and the second individual flow path Q2 can be reduced. Consequently, errors in ejection characteristics of the first nozzle N1 and the second nozzle N2 can be reduced. The ejection characteristics are the ejection speed, the ejection direction, and the ejection amount, for example. As understood from the description above, there is an advantage in that crosstalk between adjacent individual flow paths Q can be suppressed even when a plurality of individual flow paths Q are disposed in a highly dense manner.

According to the configuration of the present exemplary embodiment in which the direction P1 of the first opening O1 and the direction P2 of the second opening O2 are different, the direction of the flux occurring near the first opening O1 and the direction of the flux occurring near the second opening O2 are different. In other words, the flux occurring near the first opening O1 and the flux occurring near the second opening O2 do not easily affect each other. Accordingly, compared with a configuration in which the direction P1 of the first opening O1 and the direction P2 of the second opening O2 are the same, crosstalk between the first individual flow path Q1 and the second individual flow path Q2 can be reduced. Consequently, errors in the ejection characteristics of the first nozzle N1 and the second nozzle N2 can be reduced. In particular, in the present exemplary embodiment, since the angle formed between the direction P1 of the first opening O1 and the direction P2 of the second opening O2 is 90 degrees, the effect of reducing crosstalk between the first individual flow path Q1 and the second individual flow path Q2 is prominent.

Since the first opening O1 is closer to the energy generating portion 44 than the second opening O2, propagation of the pressure change, which is caused by the energy generating portion 44, to the first common liquid chamber K1 through the first opening O1 is facilitated. In the present exemplary embodiment, since the distance D1 is larger than the distance D2, attenuation of the pressure change propagating from the first opening O1 towards the first deforming portion 641 is facilitated. Accordingly, the effect of reducing crosstalk is prominent. Since the first opening O1 is provided in the second surface F2, and the second opening O2 is provided in the third surface F3, compared with, for example, a configuration in which the first opening O1 and the second opening O2 are provided in the same surface, the effect of reducing crosstalk is prominent. Furthermore, there is an advantage in that absorption of the pressure change, which is propagated through the first opening O1, with the first deforming portion 641 is facilitated with the configuration in which the first opening O1 opposes the first deforming portion 641. Similarly, since the fourth opening O4 opposes the second deforming portion 651, absorption of the pressure change, which is propagated through the fourth opening O4, with the second deforming portion 651 is facilitated.

In a configuration, for example, in which the position of the third opening O3 in the Z-axis direction is the same as that of the first opening O1, and the position of the fourth opening O4 in the Z-axis direction is the same as that of the second opening O2, a flow path length of the first individual flow path Q1 and the flow path length of the second individual flow path Q2 are different and errors in the ejection characteristics occur in the first nozzle N1 and the second nozzle N2. Conversely, in the configuration of the present exemplary embodiment in which the positions of the first opening O1 and the fourth opening O4 are the same in the Z-axis direction and the positions of the second opening O2 and the third opening O3 are the same in the Z-axis direction, the flow path length of the first individual flow path Q1 and the flow path length of the second individual flow path Q2 approximate each other and, accordingly, the errors in the ejection characteristics of the first nozzle N1 and the second nozzle N2 can be reduced.

Furthermore, in a configuration, for example, in which the direction P3 of the third opening O3 and the direction P1 of the first opening O1 are parallel to each other and in which the direction P4 of the fourth opening O4 and the direction P2 of the second opening O2 are parallel to each other, a flow path length of the first individual flow path Q1 and the flow path length of the second individual flow path Q2 are different and errors in the ejection characteristics occur in the first nozzle N1 and the second nozzle N2. Conversely, in the present exemplary embodiment, the direction P1 of the first opening O1 and the direction P4 of the fourth opening O4 are parallel to each other and the direction P2 of the second opening O2 and the direction P3 of the third opening O3 are parallel to each other; accordingly, the flow path length of the first individual flow path Q1 and the flow path length of the second individual flow path Q2 approximate each other. Accordingly, errors in the ejection characteristics of the first nozzle N1 and the second nozzle N2 can be reduced. Note that the relational configuration between the third opening O3 and the fourth opening O4 can achieve an effect similar to that of the effect achieved by the relational configuration between the first opening O1 and the second opening O2 described above.

Modifications

The configurations described above illustrated as examples can be modified in various ways. Specific modification modes that can be applied to the embodiments described above will be exemplified below. Two or more optionally selected modes from the examples below can be merged as appropriate as long as they do not contradict each other.

1. The shapes of the individual flow paths Q are not limited to those illustrated as examples in the above description. For example, in addition to the first flow path 111, the first pressure chamber C1, and the second flow path 112, the first communication flow path Q11 may include another flow path. Same applies to the second communication flow path Q12, the third communication flow path Q23, and the fourth communication flow path Q24. Furthermore, the shapes of the first individual flow path Q1 and the second individual flow path Q2 may be different, or the shapes of the first individual flow path Q1 and the second individual flow path Q2 may be the same. In other words, a configuration in which the positions of the first opening O1 and the fourth opening O4 in the Z-axis direction are different, or a configuration in which the positions of the second opening O2 and the third opening O3 in the Z-axis direction are different may be adopted as well.

2. In the configuration described above, the flow path substrate 32 is formed of layers including the first substrate 321 and the second substrate 322; however, the configuration of the flow path substrate 32 is not limited to the example described above. For example, the flow path substrate 32 may be formed of a single layer, or the flow path substrate 32 may be formed of at least three layers.

3. In the configuration described above, the liquid ejecting head 26 adopting both configurations, specifically, a configuration in which the positions of the first opening O1 and the second opening O2 in the Z-axis direction are different and a configuration in which the direction P1 of the first opening O1 and the direction P2 of the second opening O2 are different, has been described as an example; however, only either one of the configurations may be adopted. Even when only one of the configurations, specifically, the configuration in which the positions of the first opening O1 and the second opening O2 in the Z-axis direction are different and the configuration in which the direction P1 of the first opening O1 and the direction P2 of the second opening O2 are different, is adopted, the effect of reducing crosstalk between the first individual flow path Q1 and the second individual flow path Q2 can be obtained.

4. In the configuration described above, the first opening O1 is formed in the second surface F2 of the first common liquid chamber K1, and the second opening O2 is formed in the third surface F3; however, the positions where the first opening O1 and the second opening O2 are formed are optional. For example, the first opening O1 may be formed in the third surface F3, and the second opening O2 may be formed in the second surface F2. In other words, it is only sufficient that either one of the first opening O1 and the second opening O2 opposes the first deforming portion 641. Similarly, it is only sufficient that either one of the third opening O3 and the fourth opening O4 opposes the second deforming portion 651.

Furthermore, the first opening O1 and the second opening O2 may be formed in the same surface. For example, a configuration in which both the first opening O1 and the second opening O2 are formed in the second surface F2, or a configuration in which both the first opening O1 and the second opening O2 are formed in the third surface F3 may be adopted. Similarly, the third opening O3 and the fourth opening O4 may be formed in the same surface.

5. In the configuration described above, the first vibration absorber 64 and the second vibration absorber 65 can be omitted. In other words, it is not essential that the first deforming portion 641 constitutes a portion of the wall surface of the first common liquid chamber K1, and that the second deforming portion 651 constitutes a portion of the wall surface of the second common liquid chamber K2.

6. In the configuration described above, a configuration in which the liquid ejecting apparatus 100 includes the circulation mechanism 90 has been illustrated as an example; however, it is not essential that liquid ejecting apparatus 100 includes the circulation mechanism 90. In other words, either one of the first line L1 and the second line L2 is omitted. For example, when the second line L2 is omitted, the various elements related to the second line L2 are also omitted. For example, the second common liquid chamber K2 is omitted. In other words, the third opening O3 and the fourth opening O4 are also omitted.

7. In the configuration described above, a configuration in which the angle formed between the direction P1 of the first opening O1 and the direction P2 of the second opening O2 is 90 degrees has been illustrated as an example; however, the angle formed between the direction P1 of the first opening O1 and the direction P2 of the second opening O2 is optional. From the viewpoint of reducing crosstalk, the angle formed between the direction P1 of the first opening O1 and the direction P2 of the second opening O2 is preferably at least 45 degrees. Note that the effect of reducing crosstalk becomes prominent as the angle formed between the direction P1 of the first opening O1 and the direction P2 of the second opening O2 approaches 90 degrees. However, a configuration in which the angle formed between the direction P1 of the first opening O1 and the direction P2 of the second opening O2 is under 45 degrees can be adopted as well. Similarly, the angle formed between the direction P3 of the third opening O3 and the direction P4 of the fourth opening O4 is optional as well.

8. The energy generating portions 44 that generate energy to eject the liquid inside the pressure chambers C through the nozzles N are not limited to the piezoelectric elements. For example, heating elements that generate air bubbles inside the pressure chambers C through heating to change the pressure inside the pressure chambers C may be used as the energy generating portions 44. As it can be understood from the examples described above, the energy generating portions 44 are expressed comprehensively as elements that eject the liquid in the pressure chambers C through the nozzles N, and the operation system such as a piezoelectric system or a thermal system, and the specific configuration of the energy generating portions 44 do not need to be stated in particular. In other words, the energy to eject the liquid includes both heat and pressure.

9. While in the embodiments described above, the serial type liquid ejecting apparatus 100 in which the transport body 82 in which the liquid ejecting head 26 is mounted is reciprocated has been described as an example, a line type liquid ejecting apparatus in which a plurality of nozzles N are distributed across the entire width of the medium 12 can also be applied to the present disclosure.

10. The liquid ejecting apparatuses 100 described as examples in the embodiments described above may be employed in various apparatuses other than an apparatus dedicated to printing, such as a facsimile machine and a copier. Note that the application of the liquid ejecting apparatus of the present disclosure is not limited to printing. For example, a liquid ejecting apparatus that ejects a coloring material solution is used as a manufacturing apparatus that forms a color filter of a display device such as a liquid crystal display panel. Furthermore, a liquid ejecting apparatus that ejects a conductive material solution is used as a manufacturing apparatus that forms wiring and electrodes of a wiring substrate. Furthermore, a liquid ejecting apparatus that ejects a solution of an organic matter related to a living body is used, for example, as a manufacturing apparatus that manufactures a biochip.

What is claimed is:

1. A liquid ejecting head comprising:

a first nozzle that ejects a liquid along a first axis;

a second nozzle that ejects a liquid along the first axis;

a first individual flow path communicating with the first nozzle;

a second individual flow path communicating with the second nozzle, the second individual flow path being adjacent to the first individual flow path in a second axis orthogonal to the first axis; and a first common liquid chamber that is commonly in communication with the first individual flow path and the second individual flow path;

a second common liquid chamber that is commonly in communication with the first individual flow path and the second individual flow path, and different from the first common individual flow path, wherein the first individual flow path includes a first flow path that is nearest to the first common liquid chamber than another path in the first individual flow path, the second individual flow path includes a second flow path that is nearest to the first common liquid chamber than another path in the second individual flow path, and a direction that the first flow path extends and a direction that the second flow path extends are different.

2. The liquid ejecting head according to claim 1, wherein an angle formed between the direction that the first flow path extends and the direction that the second flow path extends is at least 45 degrees.

3. The liquid ejecting head according to claim 1, wherein an angle formed between the direction that the first flow path extends and the direction that the second flow path extends is 90 degrees.

4. The liquid ejecting head according to claim 1, wherein the common liquid chamber includes a deforming portion that deforms in response to a pressure change of a liquid inside the common liquid chamber, and the opening of the first flow path and the deforming portion oppose each other.

5. The liquid ejecting head according to claim 1, wherein the common liquid chamber includes a first surface, a second surface, and a third surface, in which the first surface and the second surface oppose each other, at least a portion of the first surface is formed of a deforming portion that deforms in response to a pressure change of a liquid inside the common liquid chamber, the opening of the first flow path is provided in the second surface, and the opening of the second flow path is provided in the third surface.

6. The liquid ejecting head according to claim 1, wherein the first individual flow path includes a third flow path that is nearer to the second common liquid chamber than another path in the first individual flow path, and the direction that the first flow path extends and a direction that the third flow path extends are different.

7. The liquid ejecting head according to claim 6, wherein the second individual flow path includes a fourth flow path that is nearer to the second common liquid chamber than another path in the second individual flow path, the direction that the second flow path extends and a direction that the fourth flow path extends are different.

8. The liquid ejecting head according to claim 7, wherein the direction that the first flow path extends and the direction that the fourth flow path extends are the same, and the direction that the second flow path extends and a direction that the third flow path extends are the same.

9. The liquid ejecting head according to claim 1, wherein the first individual flow path communicates with a first pressure chamber and the second individual flow path communicates with a second pressure chamber, a length of the first individual flow path from the first common liquid chamber to the first pressure chamber being different than a length of the second individual flow path from the first common liquid chamber to the second pressure chamber.

10. A liquid ejecting head comprising:

a plurality of nozzles that eject a liquid along a first axis;

a row of individual flow paths that includes a plurality of individual flow paths arranged in parallel along a second axis orthogonal to the first axis when viewed in a direction of the first axis;

a first common liquid chamber that is commonly in communication with the plurality of individual flow paths; and a second common liquid chamber that is commonly in communication with the plurality of individual flow paths, wherein the plurality of individual flow paths include a first individual flow path and a second individual flow path that are adjacent to each other in the row of individual flow paths, a direction of a first opening that is a connection port between the first common liquid chamber and the first individual flow path and a direction of a second opening that is a connection port between the first common liquid chamber and the second individual flow path are different, and a direction of a third opening that is a connection port between the second common liquid chamber and the first individual flow path and a direction of a fourth opening that is a connection port between the second common liquid chamber and the second individual flow path are different.

11. The liquid ejecting head according to claim 10, wherein the direction of the first opening and the direction of the fourth opening are parallel to each other, and the direction of the second opening and the direction of the third opening are parallel to each other.

12. The liquid ejecting head according to claim 10, wherein the first common liquid chamber includes a first deforming portion that deforms in response to a pressure change of a liquid inside the first common liquid chamber, the second common liquid chamber includes a second deforming portion that deforms in response to a pressure change of a liquid inside the second common liquid chamber, either one of the first opening and the second opening opposes the first deforming portion, and either one of the third opening and the fourth opening opposes the second deforming portion.

13. The liquid ejecting head according to claim 12, wherein in the first individual flow path, a first energy generating portion that generates energy to eject the liquid is provided midway of a first communication flow path that communicates the first common liquid chamber and a first nozzle in the plurality of nozzles to each other, in the second individual flow path, a second energy generating portion that generates energy to eject the liquid is provided midway of a second communication flow path that communicates the second common liquid chamber and a second nozzle in the plurality of nozzles to each other, the first opening opposes the first deforming portion, and the fourth opening opposes the second deforming portion.

14. A liquid ejecting apparatus comprising:

a liquid ejecting head according to claim 10; and a circulation mechanism that collects the liquid from either one of the first common liquid chamber and the second common liquid chamber and that recirculates the liquid to the other one of the first common liquid chamber and the second common liquid chamber.

* * * * *